US008496344B1

(12) United States Patent
Chapman

(10) Patent No.: US 8,496,344 B1
(45) Date of Patent: Jul. 30, 2013

(54) REFLECTOR AND LIGHT KIT FOR REAR OF BACKPACK

(76) Inventor: Anthony Chapman, Fort Myers, FL (US)

( * ) Notice: Subject to any disclaimer, the term of this patent is extended or adjusted under 35 U.S.C. 154(b) by 267 days.

(21) Appl. No.: 13/159,464

(22) Filed: Jun. 14, 2011

(51) Int. Cl.
*A45C 15/06* (2006.01)

(52) U.S. Cl.
USPC ..... 362/156; 362/108

(58) Field of Classification Search
USPC ..... 362/103, 108, 156, 191
See application file for complete search history.

(56) References Cited

U.S. PATENT DOCUMENTS

| | | | | |
|---|---|---|---|---|
| 5,475,574 | A | 12/1995 | Chien | |
| D382,670 | S | 8/1997 | Sayre | |
| 5,957,354 | A * | 9/1999 | Mentken | 224/614 |
| 5,979,722 | A | 11/1999 | Gonzales | |
| 6,336,222 | B1 | 1/2002 | Ware | |
| 6,932,256 | B2 | 8/2005 | Hale et al. | |
| 7,055,978 | B2 | 6/2006 | Worthington | |
| 7,270,438 | B2 | 9/2007 | Chen | |
| 2002/0036902 | A1 * | 3/2002 | Lynch et al. | 362/166 |
| 2002/0179653 | A1 | 12/2002 | Klamm | |
| 2004/0076000 | A1 * | 4/2004 | Thorp | 362/154 |
| 2004/0255359 | A1 | 12/2004 | Bordeaux | |
| 2009/0201671 | A1 | 8/2009 | Huntley | |
| 2010/0202143 | A1 * | 8/2010 | Ruehlemann et al. | 362/249.01 |

* cited by examiner

*Primary Examiner* — David V Bruce
(74) *Attorney, Agent, or Firm* — Kyle Fletcher

(57) ABSTRACT

The reflector and light kit for rear of backpack is an auto-illuminating device that reflects and emits light from a back surface of a backpack and is useful as a safety feature to an end user wearing the backpack. The reflector and light kit can be built into the construction of a new backpack or is a kit that is installed upon an existing backpack. The reflector and light kit features at least one light positioned on a rear surface of a backpack, and a highly reflective material positioned around the light. The light features a switch and light sensor that enable the end user to turn on the light, and to automatically turn off the light when in an illuminated environment.

18 Claims, 3 Drawing Sheets

REFLECTOR AND LIGHT KIT FOR REAR OF BACKPACK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of backpacks, more specifically, a kit that is built-into or added onto an existing backpack.

B. Discussion of the Prior Art

As a preliminary note, it should be stated that there is an ample amount of prior art that deals with backpacks and reflectors generally. However, no prior art discloses a kit for use with a rear of a backpack, which includes reflective material surrounding at least one light; wherein the light can be set to blink; wherein a light sensor can automatically turn off the light so as to save on energy consumption; wherein the kit may be integrated into the design of a new backpack or an after-market product that attaches onto an exterior, rear surface of an existing backpack.

The Hale et al. (U.S. Pat. No. 6,932,256) discloses a balanced backpack that includes one or more strips of reflective material. However, the balanced backpack does not feature at least one light that is surrounded by a highly reflective material that are both positioned on a rear surface of the backpack.

The Gonzales (U.S. Pat. No. 5,979,722) discloses a combination backpack and splash guard used by a bicycle rider with adjustable reflective shoulder straps and waist straps. However, the reflective shoulder straps do not work in conjunction with at least one light to both reflect and emit light in a dark environment.

The Huntley Patent Application Publication (U.S. Pub. No. 2009/0201671) discloses an illuminated backpack with a plurality of LEDs. However, the LEDs are not surrounded by a highly reflective material along the region adjacent said LEDs and on the rear surface of the backpack.

The Chen (U.S. Pat. No. 7,270,438) discloses a lighted backpack with LEDs. Again, the LEDs are not surrounded by a highly reflective material on the same rear surface of the backpack.

The Klamm Patent Application Publication (U.S. Pub. No. 2002/0179653) discloses a backpack having reflective fabric incorporated into the outer shell of the backpack. However, the reflective fabric does not include at least one light that is surrounded amongst said reflective material so as to both emit light and reflect light from the same surface of said backpack.

The Worthington (U.S. Pat. No. 7,055,978) discloses a backpack with an intermittent light. However, the intermittent light does not work in concert or simultaneous to reflective materials that surround the light along a rear surface of the backpack.

The Chien (U.S. Pat. No. 5,475,574) discloses a shoulder band with an EL light strip. However, the EL strip is not a part of a kit that surrounds a light by highly reflective material along a rear surface of a backpack such that said kit both reflects and emits light there from.

The Bordeaux Patent Application Publication (U.S. Pub. No. 2004/0255359) discloses a backpack that incorporates reflective panels. Again, the reflective panels do not include at least one light that is surrounded by the reflective material.

The Ware (U.S. Pat. No. 6,336,222) discloses a combination reflective vest and backpack. Again, the vest or backpack does not include a light impregnated amongst a region containing a highly reflective material.

While the above-described devices fulfill their respective and particular objects and requirements, they do not describe a kit for use with a rear of a backpack, which includes reflective material surrounding at least one light; wherein the light can be set to blink; wherein a light sensor can automatically turn off the light so as to save on energy consumption; wherein the kit may be integrated into the design of a new backpack or an after-market product that attaches onto an exterior, rear surface of an existing backpack. In this regard, the reflector and light kit for rear of backpack departs from the conventional concepts and designs of the prior art.

SUMMARY OF THE INVENTION

The reflector and light kit for rear of backpack is an auto-illuminating device that reflects and emits light from a back surface of a backpack and is useful as a safety feature to an end user wearing said backpack. The reflector and light kit can be built into the construction of a new backpack or is a kit that is installed upon an existing backpack. The reflector and light kit features at least one light positioned on a rear surface of a backpack, and a highly reflective material positioned around said light. The light features a switch and light sensor that enable the end user to turn on the light, and to automatically turn off said light when in an illuminated environment.

An object of the invention is to provide a reflector and light kit that is added onto a new or used rear surface of a backpack, and which emits light or reflects light to act as a safety feature that alerts to the presence of the end user from behind said end user.

A further object of the invention is to provide a reflector and light kit that includes at least one light that is surrounded by a highly reflective material such that light is either emitted from the kit or light is reflected off of said kit.

A further object of the invention is to provide the light with a switch that enables an end user to turn on or off the light at the discretion of the end user.

An even further object of the invention is to blink said light when turned on.

An even further object of the invention is to provide a light sensor that will automatically turn off the light after a predetermined period of time has elapsed such that the light sensor has detected light, and in which the light sensor will prevent unwanted use of the powering means used with the light in a lighted environment.

These together with additional objects, features and advantages of the reflector and light kit for rear of backpack will be readily apparent to those of ordinary skill in the art upon reading the following detailed description of presently preferred, but nonetheless illustrative, embodiments of the reflector and light kit for rear of backpack when taken in conjunction with the accompanying drawings.

In this respect, before explaining the current embodiments of the reflector and light kit for rear of backpack in detail, it is to be understood that the reflector and light kit for rear of backpack is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the reflector and light kit for rear of backpack.

It is therefore important that the claims be regarded as including such equivalent construction insofar as they do not depart from the spirit and scope of the reflector and light kit for rear of backpack. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
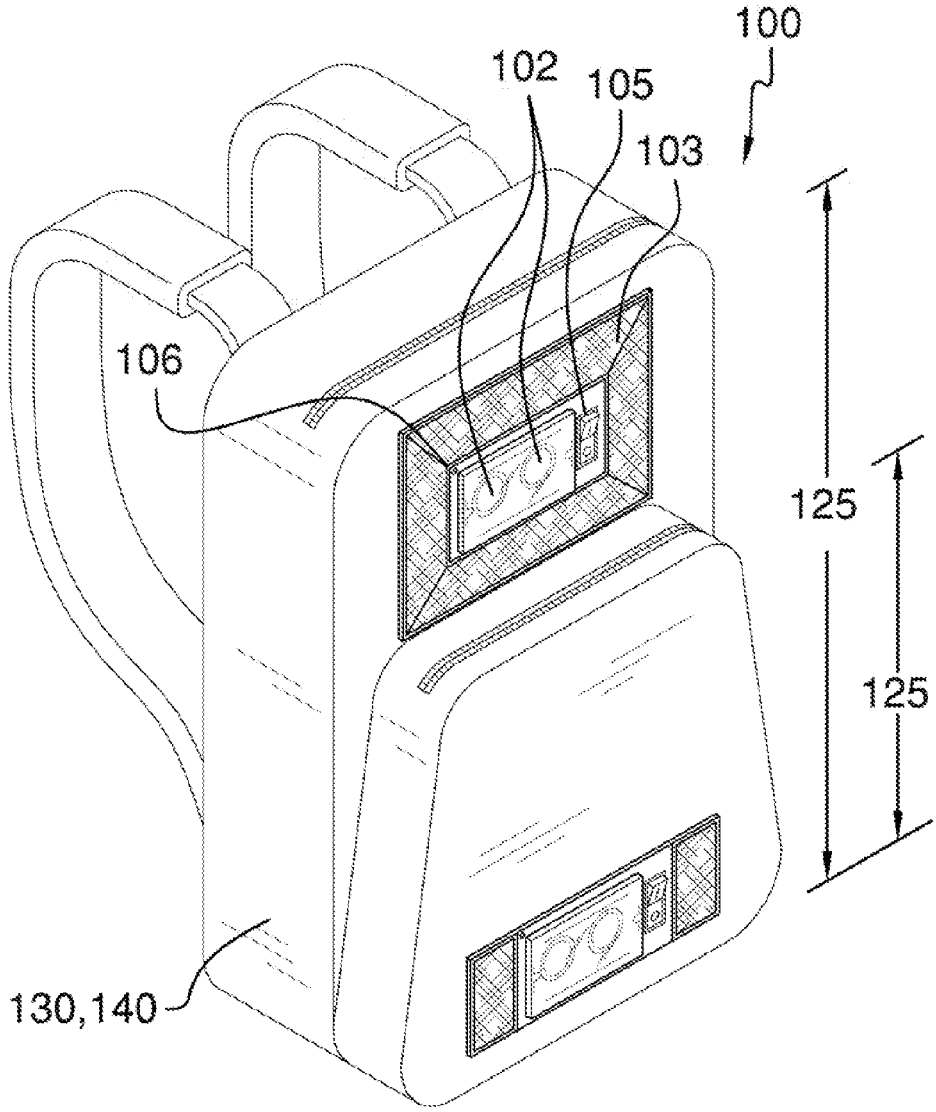
FIG. 1 illustrates a perspective view of the reflector and light kit for rear of backpack in which the kit is built into a new backpack.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-4. A reflector and light kit for rear of backpack 100 (hereinafter invention) includes a base plate 101 that is either attached onto an existing backpack 140 (see FIG. 4) or is built into a new backpack 130 (see FIG. 2).

The invention 100 is ideally suited for use on a rear surface 120 of the backpack 130, 140. The base plate 101 is responsible for most of the functions of the invention 100.

The base plate 101 includes at least one light 102, a highly reflective material 103 that surrounds the light 102, a powering means 104, a light switch 105, and a light sensor 106.

The highly reflective material 103 is already known in the art, and uses materials that are efficient in reflecting light. The highly reflective material 103 may surround all applicable sides of the light 102. However, the highly reflective material may surround opposing sides of the light 102 or most sides of the light 102.

It shall be noted that the use and amount of highly reflective material 103 is important in that the more, the better.

The light 102 may be of a type comprising an LED, an incandescent, or a fluorescent. The light switch 105 controls the light 102. The light switch 105 is also located on the base plate 101 and is immediately adjacent the light 102, and offers a means for an end user to turn on or off the light 102. The light switch 105 works with the light sensor 106 to turn off the light 102 when ambient light is detected.

It shall be noted that the term ambient light is being used to describe light that is provided by the outside environment, and may be artificial or naturally produced. More the point, the light sensor 106 will only turn off the light 102 after a predetermined period of time of ambient light is detected. For example, the predetermined amount of time may be 30 seconds of ambient light that is required before the light sensor 106 turns off the light 102. Furthermore, after a predetermined amount of time has elapsed where there is no more ambient light, the light sensor 106 can turn the light back on provided that the light switch 105 is turned to the "ON" position.

The light sensor 106 insures that the powering means 104 are used efficiently. More the point, the light sensor 106 also insures that the light 102 is used when it is dark in whatever environment the invention 100 is located.

Figure 2:
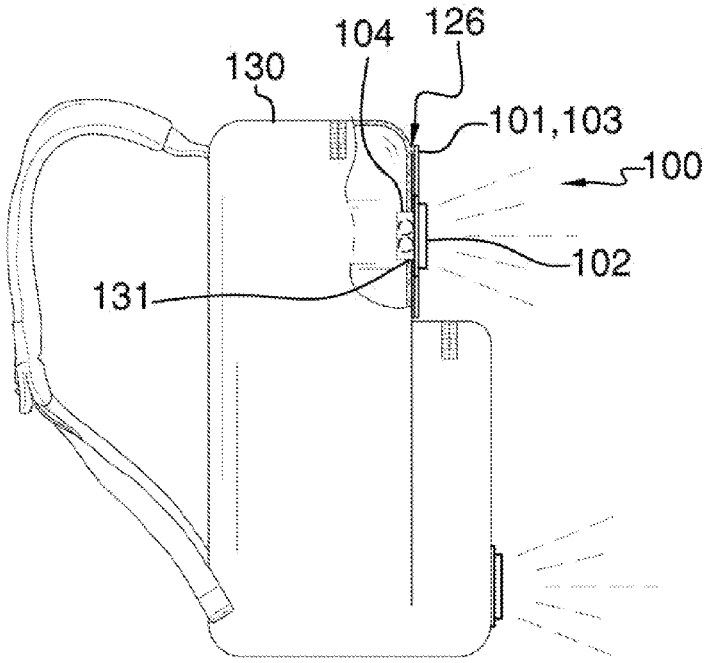
FIG. 2 illustrates a partial cut-away, side view of the reflector and light kit for rear of backpack in which battery compartment is located within the backpack while light is emitting from the back surface of the backpack.
Figure 3:
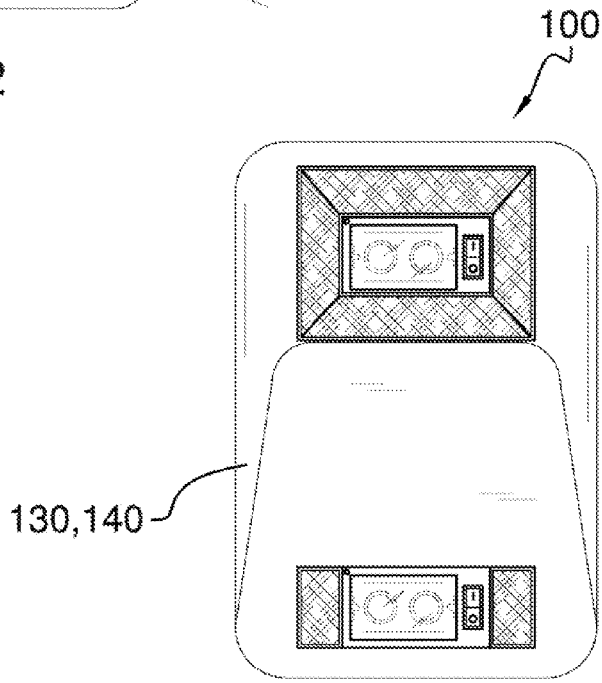
FIG. 3 illustrates a rear view of the reflector and light kit for rear of backpack.

The powering means 104 include at least one battery that provides the electricity needed to power the light 102. Referring to FIG. 2, the powering means 104 are located inside of the backpack 130; whereas in FIG. 4, the powering means 104 is located on a rear surface of the base plate 101.

Referring to the embodiment of the invention 100 when integrated into the new backpack 130 (see FIG. 2), an opening 131 is provided to enable the powering means 104 to pass across the rear surface 125. In this embodiment of the invention 100; the base plate 101 is secured to the rear surface 125 by a layer of adhesive 126.

Figure 4:
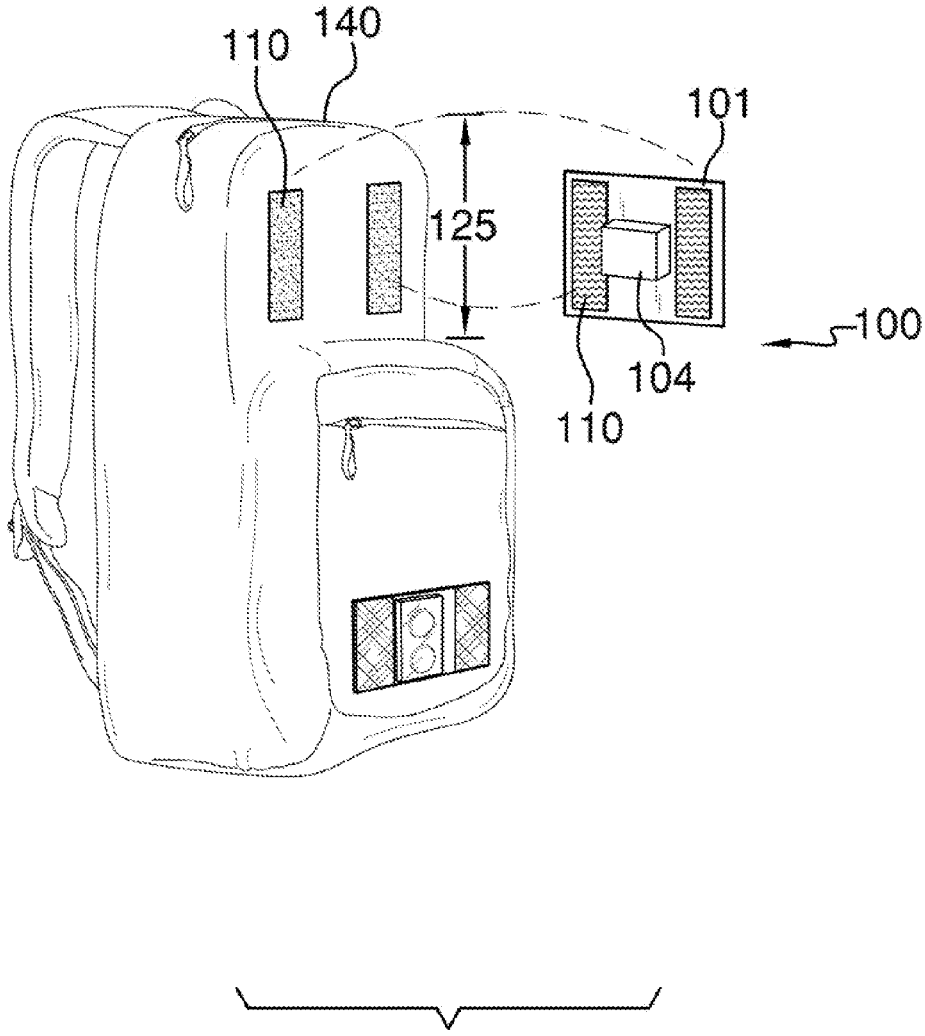
FIG. 4 illustrates a perspective view of an alternative embodiment of the reflector and light kit for rear of backpack in which the kit attaches onto the outer surface of an existing backpack.

Referring to the embodiment of the invention 100 in FIG. 4, attaching means 110 are used to secure the base plate 101 onto the rear surface 125 of the backpack 140. The attaching means 110 comprise of at least one nylon hook and loop strip, which enable the invention 100 to be temporarily installed and removed from the backpack 140.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A reflector and light kit for rear of backpack comprising:

a base plate onto which at least one light is provided and surrounded upon by at least two sides by a highly reflective material;

wherein the base plate is installed upon a rear surface of a backpack and enables the light to emit light and simultaneously enables the highly reflective material to reflect light so as to further improve the general awareness of an end user and said backpack.

2. The reflector and light kit for rear of backpack as described in claim 1 wherein the light is in connection with a light switch that is positioned adjacent said light, and controls operation thereof.

3. The reflector and light kit for rear of backpack as described in claim 2 wherein a light sensor is provided on said base plate, and controls operation of the light such that upon detection of ambient light for a predetermined amount of time, said light is turned off.

4. The reflector and light kit for rear of backpack as described in claim 3 wherein the light sensor can turn on said light after a predetermined amount of time has elapsed without detection of said ambient light.

5. The reflector and light kit for rear of backpack as described in claim 1 wherein the light is powered by a powering means comprising at least one battery.

6. The reflector and light kit for rear of backpack as described in claim 5 wherein the powering means is located on a rear surface of the base plate.

7. The reflector and light kit for rear of backpack as described in claim 1 wherein the light is of a form comprising an LED, an incandescent, or a fluorescent light.

8. The reflector and light kit for rear of backpack as described in claim 6 wherein the base plate is built into a new backpack, and of which includes an opening on the rear surface of the backpack that enables the powering means to pass into the backpack whereas the base plate rests against the rear surface of the backpack.

9. The reflector and light kit for rear of backpack as described in claim 8 wherein the base plate is secured against the rear surface of the backpack via a layer of adhesive.

10. The reflector and light kit for rear of backpack as described in claim 6 wherein the base plate includes attaching means used to secure the base plate onto the rear surface of the backpack; wherein the attaching means comprises at least one hook and loop strip, which enables the base plate to be installed and removed from the rear surface of an existing backpack.

11. A reflector and light kit for rear of backpack comprising:

a base plate onto which at least one light is provided and surrounded upon by at least two sides by a highly reflective material;

wherein the base plate is installed upon a rear surface of a backpack and enables the light to emit light and simultaneously enables the highly reflective material to reflect light so as to further improve the general awareness of an end user and said backpack;

wherein the light is in connection with a light switch that is positioned adjacent said light, and controls operation thereof;

wherein a light sensor is provided on said base plate, and controls operation of the light such that upon detection of ambient light for a predetermined amount of time, said light is turned off.

12. The reflector and light kit for rear of backpack as described in claim 11 wherein the light sensor can turn on said light after a predetermined amount of time has elapsed without detection of said ambient light.

13. The reflector and light kit for rear of backpack as described in claim 11 wherein the light is powered by a powering means comprising at least one battery.

14. The reflector and light kit for rear of backpack as described in claim 13 wherein the powering means is located on a rear surface of the base plate.

15. The reflector and light kit for rear of backpack as described in claim 11 wherein the light is of a form comprising an LED, an incandescent, or a fluorescent light.

16. The reflector and light kit for rear of backpack as described in claim 15 wherein the base plate is built into a new backpack, and of which includes an opening on the rear surface of the backpack that enables the powering means to pass into the backpack whereas the base plate rests against the rear surface of the backpack.

17. The reflector and light kit for rear of backpack as described in claim 16 wherein the base plate is secured against the rear surface of the backpack via a layer of adhesive.

18. The reflector and light kit for rear of backpack as described in claim 11 wherein the base plate includes attaching means used to secure the base plate onto the rear surface of the backpack; wherein the attaching means comprises at least one hook and loop strip, which enables the base plate to be installed and removed from the rear surface of an existing backpack.

* * * * *